United States Patent [19]

Birt

[11] 4,364,816

[45] Dec. 21, 1982

[54] RECORD MATRIX PREPARATION

[75] Inventor: David E. Birt, Hanwell, England

[73] Assignee: EMI Limited, Hayes, England

[21] Appl. No.: 213,483

[22] Filed: Dec. 5, 1980

[30] Foreign Application Priority Data

Dec. 7, 1979 [GB] United Kingdom ..... 7942336

[51] Int. Cl.[3] ..... C25D 1/10; C25D 2/00

[52] U.S. Cl. ..... 204/297 W; 204/4; 204/5

[58] Field of Search ..... 204/4, 5, 15, 23, 297 R, 204/297 W

[56] References Cited

U.S. PATENT DOCUMENTS 2,852,463 9/1958 Gutzmer ..... 204/242

3,414,502 12/1968 Porrata et al. ..... 204/281

4,092,234 5/1978 Horst et al. ..... 204/286

FOREIGN PATENT DOCUMENTS 1419139 12/1975 United Kingdom .

*Primary Examiner*—F. Edmundson

*Attorney, Agent, or Firm*—Fleit & Jacobson

[57] ABSTRACT

An apparatus, for use in an electroplating arrangement, for establishing electrical contact with a metal or metalized cathode plate used in production of a disc record matrix. The apparatus includes an electrically conductive contact member and a clamping means for holding the contact member against a cathode plate supported by the apparatus. The contact member and clamping means are shaped so that electrical contact is established at the periphery only of the cathode plate.

4 Claims, 4 Drawing Figures

RECORD MATRIX PREPARATION

Figure 1:
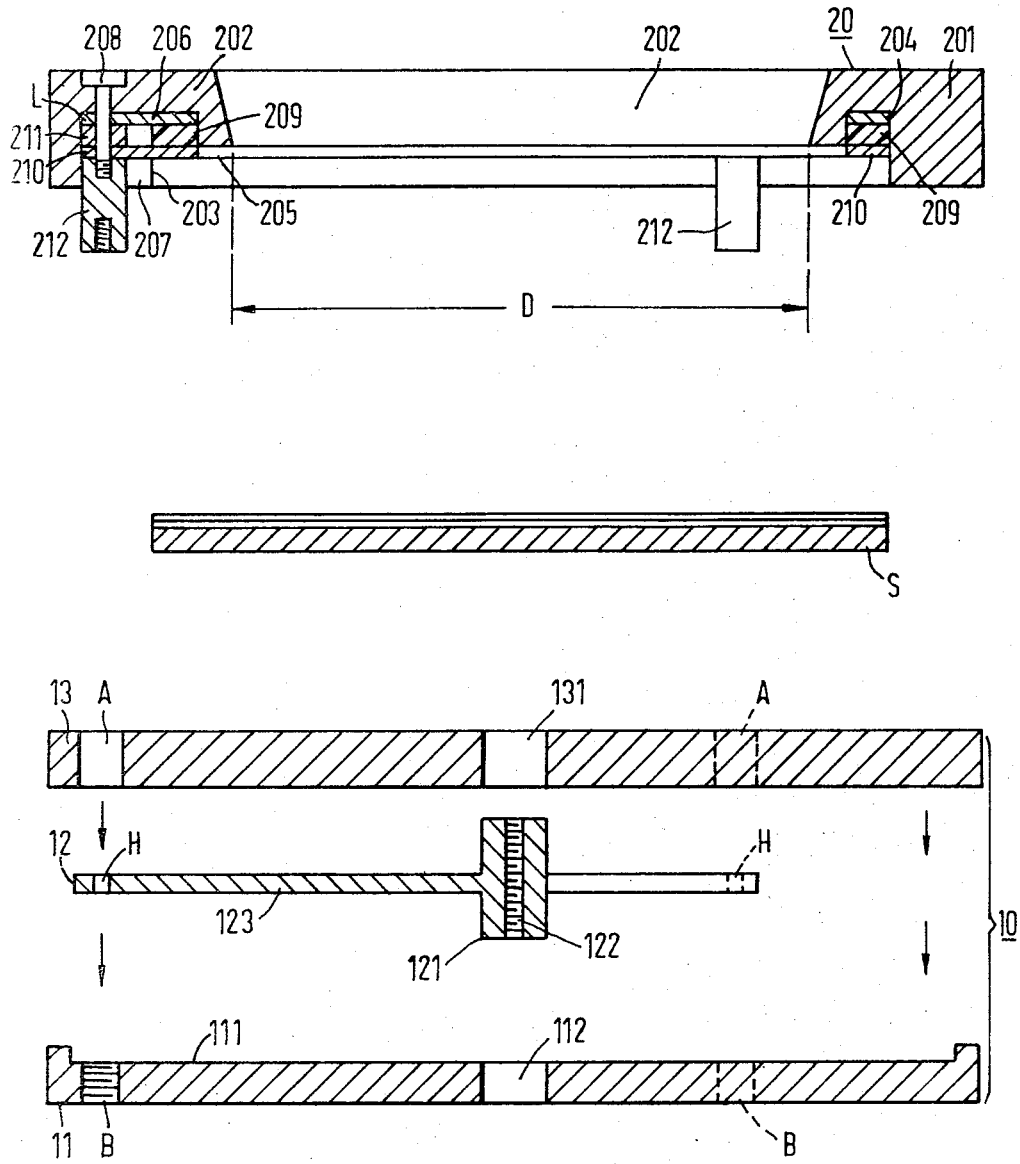
Figure 2A:
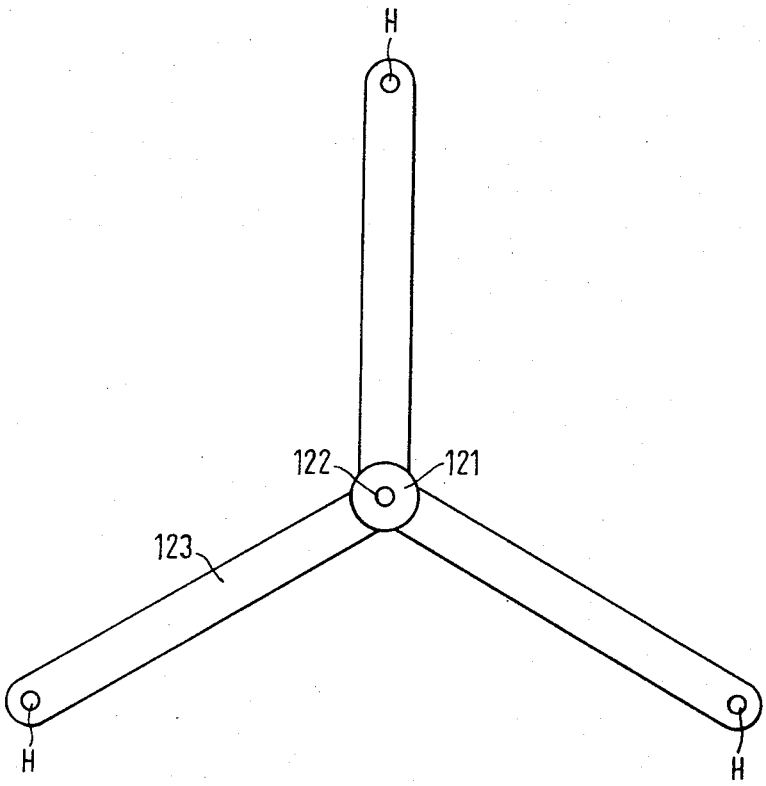
Figure 2B:
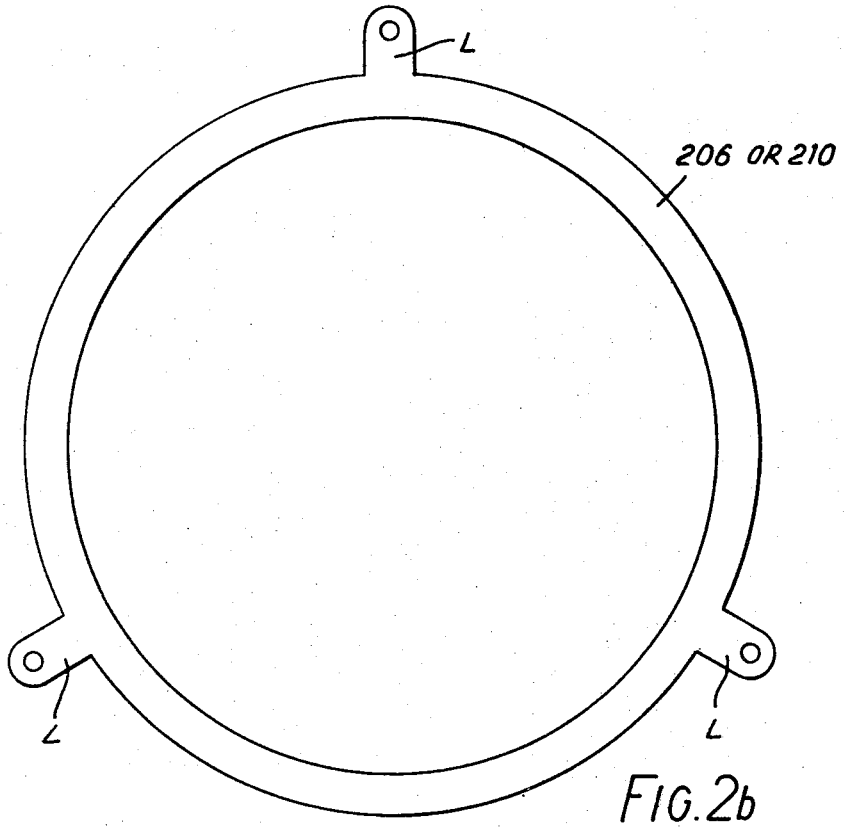

This invention relates to record matrix preparation and especially, although not exclusively, to the preparation of video disc matrices.

As in the case of audio recordings, a matrix which may be used to mould a "cake" or foil of a plastics material to form a video disk, is derived, from a "master" of the recorded data or imformation. A video disc "moster" is commonly comprised of a glass plate which has been ground to form a flat surface having a uniformity commensurate with the microscopic scale of the relief structure, representing the recorded data or information. A flash of chrome (typically 150 Å thick) is applied to the surface of the plate and a layer of a positive photoresistive material (typically 0.2 μm thick) deposited over the chrome. The photoresistive layer is exposed using laser light and then developed to reveal a pattern of pits or holes (typically 1–2 μm across and no more than 0.2 μm deep) representative of the information or data. A thin gold deposit (~ 1000 A thick) is then applied over the exposed layer by an evaporation technique and the resulting surface electroplated with nickel to form a layer about 0.5 mm thick. The photoresistive layer may then be dissolved to release the gold coated nickel layer which bears a negative impression of the relief structure at its surface and may be used as a stamper. As is known in the art, the above-described technique may also be used in the preparation of audio recordings, especially audio digital recordings.

In order to electroplate the gold surface it is necessary to make an electrical contact therewith, a procedure commonly referred to as electrotyping. The electrotyped surface is then used as the cathode surface which is positioned opposite an anode basket in an electroforming arrangement. It is found in practice however, that the conventional techniques of electrotyping (e.g. the use of an electrically conducting stud screwed into the surface of the plate) are extremely difficult to employ without also causing irrevocable damage to the supporting glass plate.

It is an object of the present invention to provide an alternative and improved arrangement for making electrical contact with a metal or a metalised plate suitable for the production of record matrices.

Accordingly there is provided an apparatus for establishing electrical contact with a metal or metalised cathode plate used in production of a disc record matrix, the apparatus comprising an electrically conductive contact member, and a clamping means which is adapted for holding the contact member against a cathode plate and for supplying electric current thereto, the clamping means and the contact member being shaped so that electrical contact is established substantially at the periphery only of the cathode plate.

The present arrangement may be suitable for use with a plate of the kind described above, used in the preparation of an audio or video matrix, but it may alternatively be suitable for use with a metalised lacquer "master", or a metal (e.g. nickel) matrix derived therefrom, used in the preparation of matrices for audio recordings ("positives" or "stampers").

The clamping means may comprise a first member for supporting a cathode plate, a generally annular second member adapted to be maintained against the first member to surround a supported cathode plate, the second member having a flange portion disposed to overlie the periphery of a supported cathode plate and dimensioned to hold thereagainst, so as to establish said electrical contact therewith, a contact member disposed between the cathode plate and the flange.

The apparatus may include a resilient material member disposed between the flange and the contact member.

The clamping means may include a plurality of spaced electrical conductors for conveying electric current to the contact member, each conductor comprising an electrically conductive strip extending substantially radially from a common location at the centre of the first member and an electrically conductive linkage member connecting each said strip to the contact member.

The contact member may comprise a generally annular disc having a plurality of integral spaced lugs for contacting the linkage members.

Figure 3:
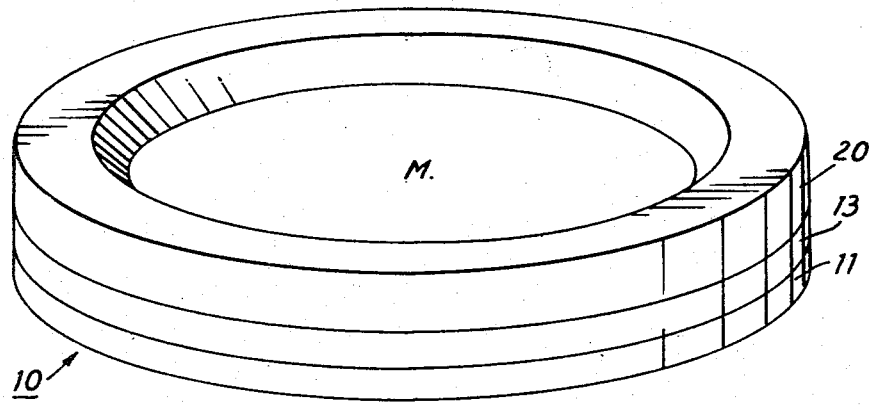

In order that the present invention may be more fully understood a specific embodiment, in accordance with one example of the invention, is described by reference to the accompanying drawings of which, FIG. 1 shows an exploded side elevation sectional view through the centre of the arrangement, FIGS. *2a* and *2b* respectively show plan views of the current spider and the contact ring (or the contact member) and FIG. 3 shows a perspective view of the assembled arrangement.

Referring to FIG. 1 of the drawings, the arrangement is comprised of two basic components, namely a support member 10, and a clamp member 20.

The support member is itself formed of three elements, a circular base plate 11, a complementary top plate 13, and a current spider 12. Both the base and the top plate are made of perspex although other insulating materials, teflon for example, could alternatively be used. The current spider is made of brass, although other electrically conducting materials, e.g. copper, could alternatively be used, and includes a central cylindrical member 121 having an axial, tapped hole 122. As shown in the plan view of FIG. *2a*, three symmetrically disposed fingers 123 extend radially outwards from the member 121, each finger having a hole, H, at its tip. The fingers 123 and the lower portion of the cylindrical member 121 are respectively accommodated within a complementary recess 111 and a hole 112 within the base plate 11. The upper portion of the cylindrical member 121 is similarly accommodated within a central hole 131 of the top plate 13 to which the base plate is to be cemented, thereby encapsulating the current spider 12. The top and base plates have a respective aperture A and tapped hole B corresponding to the position of each hole H in a finger of the current spider, when the spider is located.

The clamp member 20 is also formed of perspex and comprises an annulus 201, having the same outside diameter as the composite support member 10 (in this example 412 mm), and having a chamfered flange 202 projecting from its inner circumferential surface 203. The flange 202 has a circular recess 204 set into its lower surface 205 and a flat brass contact ring 206 is housed within this recess. As shown in the plan view of FIG. *2b*, the contact ring has three symmetrically disposed lugs L which are accommodated within respective complementary cavities, such as 207, cut into the inner wall of the annulus. FIG. 1 shows a section through one such cavity. Each lug L is secured in position within its cavity by means of a brass bolt 208 introduced through the upper surface of the clamp member. Turning the clamp member upside down, a rubber ring 209 overlies the contact ring within the recess and an aluminium contact member 210, typically only 125 μm thick, is positioned over the rubber ring. The aluminium contact member, having the same shape as the contact ring 206, also has three symmetrically disposed lugs which are located over the bolts 208 projecting through the lugs of the contact ring. A brass washer 211 fills the spaces between each pair of lugs within a cavity.

To assemble the arrangement the contact member is located over the bolts 208 and secured in position by means of cylindrical brass bushes 212. A metalised plate, S, which may, for example, be a video disc master of the kind described above, is then seated against the flange of the clamp member 20 thereby engaging the contact member 210. The support member 10 is then positioned over the plate S, each bush 212 being accommodated within the associated aperture A in the top plate 13 thereby making electrical contact with the current spider 12. Bolts are then introduced through the holes B in the base plate 11 and are screwed into the bushes 212, thereby sandwiching the plate S between the flanged clamp member 20 and the support member 10.

The rubber ring 209 provides a resilient buffer between the plate S and the clamp member 20 and so permits the plate to make excellent electrical contact with the current member whilst minimising possible damage to the fragile glass substrate.

The assembled arrangement is shown in FIG. 3, and the exposed metal surface which is to be electroplated is indicated at M. The internal diameter D of the clamp member 20 is of course sufficiently large to permit exposure of a surface area which overlies at least the entire portion of the plate S which is to contain a recording. In the present example the internal diameter D is 336 mm which is more than adequate for a video disc 300 mm in diameter.

Once assembled, the arrangement is mounted for rotation opposite an anode basket in an electroforming tank. This is achieved by means of a threaded spindle onto which the central member of the encapsulated current spider is screwed. Using the above described arrangement the current introduced at the centre of the current spider, through the mounting, is evenly distributed to the contact member via the brass bushes 212 and the contact ring 206, and this serves to enhance the uniformity of the electrodeposited layer.

It will be appreciated that although the above described arrangement, and other arrangements encompassed by the invention, are particularly suitable for electroplating a metalised, glass based, substrate of the type used for a video disc master, the arrangement may also be used in the preparation of matrices (positives or stamper for example) used in audio recording.

What I claim is:

1. An electroplating arrangement comprising a metal or metalised cathode plate suitable for use in production of a disc record matrix, a current terminal located on an axis intersecting substantially the centre of said cathode plate and an electrically conducting annular contact member, a clamping means including a current distribution member, said clamping means being adapted to hold said contact member against said cathode plate, said current distribution member establishing a substantially uniform distribution of current from said terminal to the contact member, wherein the distribution member comprises a plurality of spaced electrical conductors, said conductors comprising an electrically conductive strip extending substantially radially from a common location on said axis and including an electrically conductive linkage member connecting each said strip to the contact member.

2. An arrangement according to claim 1 wherein the current distribution member is integral with the current terminal.

3. An arrangement according to claim 1 wherein the contact member comprises an annular ring including a plurality of integrally spaced lugs for contacting said linkage member.

4. An arrangement according to claim 3 wherein the clamping means comprises a first member for supporting a cathode plate, a generally annular second member adapted to be maintained against said first member, to surround a supported cathode, the first member including a resilient flange portion to overlie said contact member.

* * * * *